US011035063B2

(12) United States Patent
Alexander et al.

(10) Patent No.: US 11,035,063 B2
(45) **Date of Patent: *Jun. 15, 2021**

(54) FABRIC TREATING APPLIANCE

(71) Applicant: WHIRLPOOL CORPORATION, Benton Harbor, MI (US)

(72) Inventors: Benjamin E. Alexander, Stevensville, MI (US); Brent M. Burgess, Edwardsburg, MI (US); Michael K. Cluskey, Saint Joseph, MI (US); Christopher A. Jones, Saint Joseph, MI (US); Dale E. Mueller, Benton Harbor, MI (US); Zachary Bohenick, Troy, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 231 days.

This patent is subject to a terminal disclaimer.

(21) Appl. No.: 16/214,655

(22) Filed: Dec. 10, 2018

(65) Prior Publication Data

US 2019/0106825 A1 Apr. 11, 2019

Related U.S. Application Data

(63) Continuation of application No. 14/809,529, filed on Jul. 27, 2015, now Pat. No. 10,179,963.

(51) Int. Cl.
*D06F 23/04* (2006.01)
*D06F 21/08* (2006.01)
(Continued)

(52) U.S. Cl.
CPC ..... *D06F 23/04* (2013.01); *D06F 21/08* (2013.01); *D06F 39/083* (2013.01);
(Continued)

(58) Field of Classification Search
CPC ..... D06F 23/04; D06F 21/08; D06F 39/083; D06F 39/086; D06F 17/10; D06F 33/00
(Continued)

(56) References Cited

U.S. PATENT DOCUMENTS 1,751,982 A 3/1930 Dunham
2,331,700 A 10/1943 Kirby
(Continued)

FOREIGN PATENT DOCUMENTS

EP 2746448 A1 6/2014
EP 2746449 A1 6/2014
(Continued)

*Primary Examiner* — Tinsae B Ayalew
(74) *Attorney, Agent, or Firm* — McGarry Bair PC

(57) ABSTRACT

A fabric treating appliance includes a rotatable basket defining a treating chamber for receiving a load of laundry items for treatment. A float valve can be incorporated into the basket structure, selectively opening or closing the valve based upon the liquid level in a tub. As liquid fills the tub, the float valve will rise until it moves into a closed position, permitting the basket and treating chamber to fill with liquid. As the tub drain, the float valve can fall, opening the valve and permitting liquid to drain from the basket or treating chamber. The opened or closed positions can be selectively operated by opening or closing a pump or sump and allowing a tub to drain or fill, respectively.

13 Claims, 7 Drawing Sheets

(51) Int. Cl.
*D06F 39/08* (2006.01)
*D06F 17/10* (2006.01)
*D06F 33/00* (2020.01)

(52) U.S. Cl.
CPC ..... *D06F 39/086* (2013.01); *D06F 17/10* (2013.01); *D06F 33/00* (2013.01)

(58) Field of Classification Search
USPC ..... 8/158
See application file for complete search history.

(56) References Cited

U.S. PATENT DOCUMENTS

| | | | |
|---|---|---|---|
| 2,470,140 | A | 5/1949 | Castner |
| 2,641,918 | A | 6/1953 | Smith |
| 2,645,109 | A | 7/1953 | Smith |
| 2,656,700 | A | 10/1953 | Smith |
| 2,711,827 | A | 6/1955 | Smith |
| 2,973,637 | A | 3/1961 | Sisson |
| 3,313,130 | A | 4/1967 | Douglas |
| 3,382,882 | A | 5/1968 | McLawhorn |
| 4,637,230 | A | 1/1987 | Roberts |
| 5,152,159 | A | 10/1992 | Kabeya et al. |
| 5,727,402 | A | 3/1998 | Wada |
| 7,350,380 | B2 | 4/2008 | Kim et al. |
| 2011/0232698 | A1* | 9/2011 | Gomez Caudevilla ..... D06F 39/086 134/184 |
| 2013/0036776 | A1 | 2/2013 | Seo et al. |

FOREIGN PATENT DOCUMENTS

| | | | |
|---|---|---|---|
| JP | 54015913 | Y2 | 6/1979 |
| WO | 2006129159 | A1 | 12/2006 |

* cited by examiner

FABRIC TREATING APPLIANCE

CROSS-REFERENCE TO RELATED APPLICATIONS

This application is a continuation of U.S. patent application Ser. No. 14/809,529, filed Jul. 27, 2015, now U.S. Pat. No. 10,179,963, issued Jan. 15, 2019, which is incorporated herein by reference in its entirety.

BACKGROUND

Fabric treating appliances, such as washing machines, clothes dryers, refreshers, and non-aqueous systems, can have a configuration based on a rotating container that at least partially defines a treating chamber in which laundry items are placed for treating. Traditionally, in a vertical axis washing machine, the container is a perforated basket, which is located within an imperforate tub, with both the basket and tub typically having an upper opening at their respective ends. The tub surrounds the basket and generally has a height as tall as or taller than the basket to catch water exiting the perforations of the basket for the full height of the basket. The tub also defines a sump to which a pump is fluidly coupled. The pump may be a drain-only pump or may also be a recirculation pump. In many cases, separate drain and recirculation pumps are used.

During a wash or rinse cycle, to fill the basket to a predetermined level with liquid, the pump or sump must be sealed such that the entire volume of the tub can be filled with water, requiring more liquid than necessary.

During a spin cycle, the tub necessarily extends the entire length of the basket such that any liquid escaping from the basket through the perforations is captured. Thus, the volume of the basket and the amount of laundry capable of treatment in a load is limited by the size of the tub.

BRIEF SUMMARY

In one aspect, the disclosure relates to a fabric treating appliance for treating laundry according to a cycle of operation, comprising: a tub defining a tub interior and having a tub upper terminal edge defining a tub access opening; a basket defining a laundry treating chamber and having a basket end, an inner wall terminating at a basket terminal edge and having a plurality of perforations, and an outer wall spaced outwardly from the inner wall to define an annular intervening space between the inner wall and the outer wall, the basket end located within the tub interior, the basket terminal edge and at least some of the plurality of perforations located vertically above the tub terminal edge, and the basket having at least one through opening fluidly coupling the laundry treating chamber to the tub interior to define a drain opening; and a float valve having a valve body located within the tub interior and moveable between an opened position, where the valve body is spaced from the drain opening enabling fluid flow through the drain opening, and a closed position, where the valve body closes the drain opening to prohibit fluid flow through the drain opening, in response to a level of liquid in the tub interior; whereby the basket permits the level of liquid in the laundry treating chamber to fill above the tub terminal edge when the float valve is in the closed position.

In another aspect, the disclosure relates to a method of operating a laundry treating appliance comprising a tub with a terminal edge and a dual-wall basket, with outer and inner walls, the inner wall having perforations above the terminal edge, and the basket located within the tub and having at least one drain opening in a bottom of the basket, the method comprising: altering a level of liquid in the tub to correspondingly alter a height of a float valve in the tub to selectively open/close the drain opening to effect a filling of liquid in the basket above the tub terminal edge when the float valve is in the closed position.

DETAILED DESCRIPTION

Figure 1:
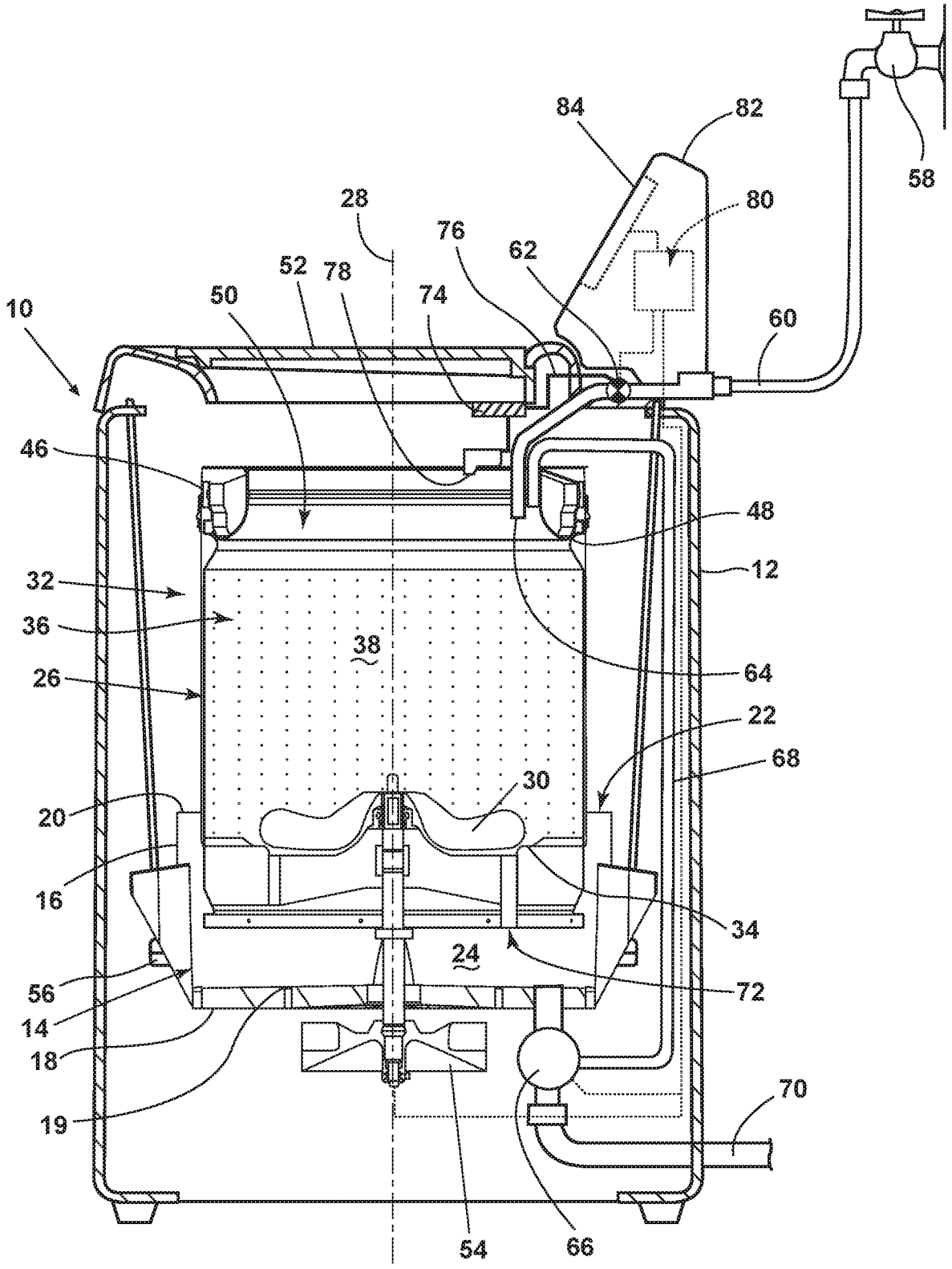
FIG. 1 illustrates a schematic sectional view of a fabric treating appliance in the form of a washing machine having a float valve assembly according to an embodiment of the invention.

FIG. 1 is a schematic sectional view of a fabric treating appliance in the form of a washing machine 10 according to one embodiment of the invention. While the fabric treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

The washing machine 10 can include a structural support system comprising a cabinet 12 that defines a housing within which a laundry holding system resides. The cabinet 12 can be a housing having a chassis and/or a frame, defining an interior that receives components typically found in a conventional washing machine, such as motors, pumps, fluid lines, controls, sensors, transducers, and the like. Such components will not be described further herein except as necessary for a complete understanding of the invention.

The fabric holding system of the illustrated exemplary washing machine 10 can include a tub 14 installed in the cabinet 12. The tub 14 can have a generally cylindrical side or tub peripheral wall 16 closed at its bottom end by a base 18 that can at least partially define a sump 19. A tub terminal edge 20 of the tub peripheral wall 16 can define a tub access opening 22 to a tub interior 24.

A basket 26 can be mounted in the tub 14 for rotation about a basket axis of rotation 28. A laundry mover 30 may be located with the basket 26 and rotated about the basket axis of rotation 28. Other exemplary types of laundry movers include, but are not limited to, an agitator, a wobble plate, and a hybrid impeller/agitator. The basket 26 can have a generally peripheral wall 32, which is illustrated as a cylindrical side wall, closed at the basket end by a basket bottom 34 to form a basket interior 36 at least partially defining a laundry treating chamber 38 receiving a load of laundry items for treatment. The peripheral wall 32 of the basket 26 can further comprise a dual wall, permitting the flow of liquid between the walls.

The upward extent of the tub peripheral wall 16 can terminate approximately at the top of the basket bottom 34. The upward extent of the tub peripheral wall 16 can be determined by the volume of liquid that is expected to be retained within the tub 14 during the cycle of operations selected for the washing machine 10. The dual wall structure of the basket 26 does provide the option that the tub 14 need not be used to contain all of the contemplated liquid or to catch all of the liquid during spin as the dual walls perform these functions. Thus, the upward extent of the tub peripheral wall 16 can be much less when compared to a traditional tub.

A balance ring 46 is disposed at the top of the basket 26 to counterbalance a load imbalance that can occur within the treating chamber 38 during a cycle of operation. The basket 26, opposite of the basket bottom 34, terminates in a basket terminal end 48 defining a basket access opening 50. The balance ring 46 can further couple to the basket terminal end 48. The top of the cabinet 12 can include a selectively openable lid 52 to provide access into the laundry treating chamber 38 through an open top of the basket 26.

A drive system including a drive motor 54 coupled to a drive shaft assembly, which can or cannot include a gear case, can be utilized to rotate the basket 26 and the laundry mover 30. The motor 54 can rotate the basket 26 at various speeds, including at a spin speed wherein a centrifugal force at the inner surface of the basket peripheral wall 32 is 1 g or greater; spin speeds are commonly known for use in extracting liquid from the laundry items in the basket 26, such as after a wash or rinse step in a treating cycle of operation. The motor 54 can also oscillate or rotate the laundry mover 30 about the basket axis of rotation 28 during a cycle of operation in order to provide movement to the load contained within the laundry treating chamber 38.

A suspension system 56 can dynamically hold the tub 14 within the cabinet 12. The suspension system 56 can dissipate a determined degree of vibratory energy generated by the rotation of the basket 26 and/or the laundry mover 30 during a treating cycle of operation. Together, the tub 14, the basket 26, and any contents of the basket 26, such as liquid and laundry items, define a suspended mass for the suspension system 56.

The washing machine 10 can be fluidly connected to a liquid supply 58 through a liquid supply system including a liquid supply conduit 60 having a valve assembly 62 that can be operated to selectively deliver liquid, such as water, to the tub 14 through a liquid supply outlet 64, which is shown by example as being positioned at one side of the tub 14. The liquid supply 58 can be a household water source.

The washing machine 10 can further include a recirculation and drain system having a pump assembly 66 that can pump liquid from the tub 14 through a recirculation conduit 68 for recirculation of the liquid back into the tub 14 and/or to a drain conduit 70 to drain the liquid from the washing machine 10. The basket 26 can further comprise a drain 72, fluidly coupling the basket 26 to the tub 14.

The washing machine 10 can also be provided with a dispensing system for dispensing treating chemistry to the basket 26, either directly or mixed with water from the liquid supply system, for use in treating the laundry according to a cycle of operation. The dispensing system can include a dispenser 74, which can be a single use dispenser, a bulk dispenser, or a combination of a single use and bulk dispenser. Liquid can be supplied to the dispenser 74 from the liquid supply conduit 60 by directing the valve assembly 62 to direct the flow of liquid to the dispenser 74 through a dispensing supply conduit 76. In this case, the valve assembly 62 can be a diverter valve having multiple outlets such that the diverter valve can selectively direct a flow of liquid to one or both of the liquid supply outlet 64 and the dispensing supply conduit 76. Additionally, the dispenser 74 can fluidly couple to the basket access opening through a dispenser outlet 78.

It is noted that the illustrated drive system, suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 26 such that liquid can be supplied directly to the tub 14 without having to travel through the basket 26. In another example, the liquid supply system can include separate valves for controlling the flow of hot and cold water from the household water source. In another example, the recirculation and pump system can include two separate pumps for recirculation and draining, instead of the single pump as previously described.

The washing machine 10 can also be provided with a heating system (not shown) to heat liquid provided to the treating chamber 38. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a control system for controlling the operation of the washing machine 10 to implement one or more treating cycles of operation. The control system can include a controller 80 located within a console 82 on top of the cabinet 12, or elsewhere, such as within the cabinet 12, and a user interface 84 that is operably coupled with the controller 80. The user interface 84 can include one or more knobs, dials, switches, displays, touch screens and the like for communicating with the user, such as to receive input and provide output. The user can enter different types of information including, without limitation, cycle selection and cycle parameters, such as cycle options.

The controller 80 can include the machine controller and any additional controllers provided for controlling any of the components of the washing machine 10. For example, the controller 80 can include the machine controller and a motor controller. Many known types of controllers can be used for the controller 80. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
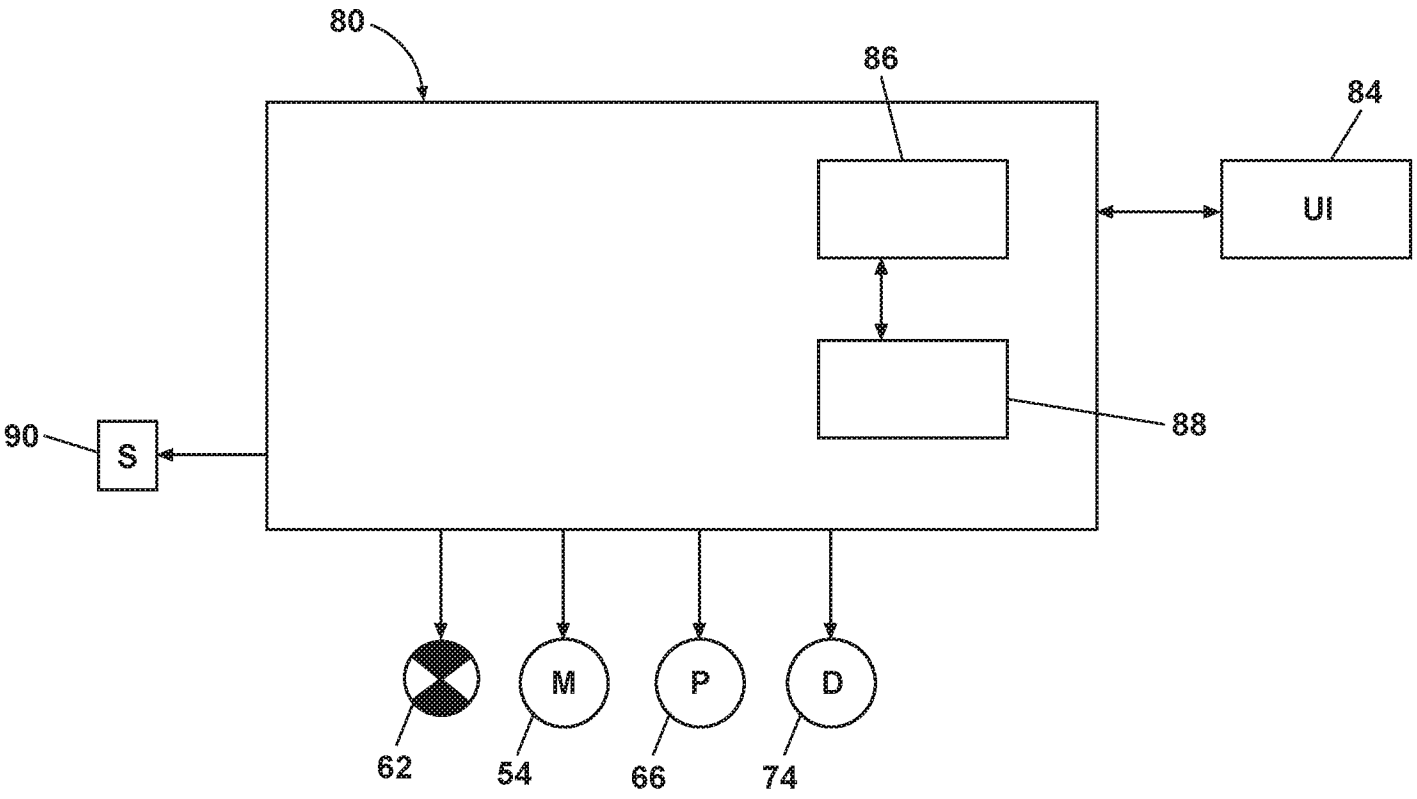
FIG. 2 illustrates a schematic view of a control system of the fabric treating appliance of FIG. 1.

FIG. 2 is a schematic view of the control system of the washing machine 10. The controller 80 can be provided with a memory 86 and a central processing unit (CPU) 88. The memory 86 can be used for storing the control software that is executed by the CPU 88 in completing a treating cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 84. The memory 86 can also be used to store information, such as a database or table, and to store data received from one or more components of the washing machine 10 that can be communicably coupled with the controller 80. The database or table can be used to store the various operating parameters for the one or more cycles of operation, including factory default values for the operating parameters and any adjustments to them by the control system or by user input.

The controller 80 can be operably coupled with one or more components of the washing machine 10 for communicating with and controlling the operation of the component to complete a cycle of operation. For example, the controller 80 can be operably coupled with the motor 54, the valve assembly 62, the pump assembly 66, the dispenser 74, and any other additional components that can be present such as a steam generator and/or a sump heater (not shown) to control the operation of these and other components to implement one or more of the cycles of operation. The controller 80 can also be coupled with one or more sensors 90 provided in one or more of the systems of the washing machine 10 to receive input from the sensors, which are known in the art and not shown for simplicity.

Figure 3:
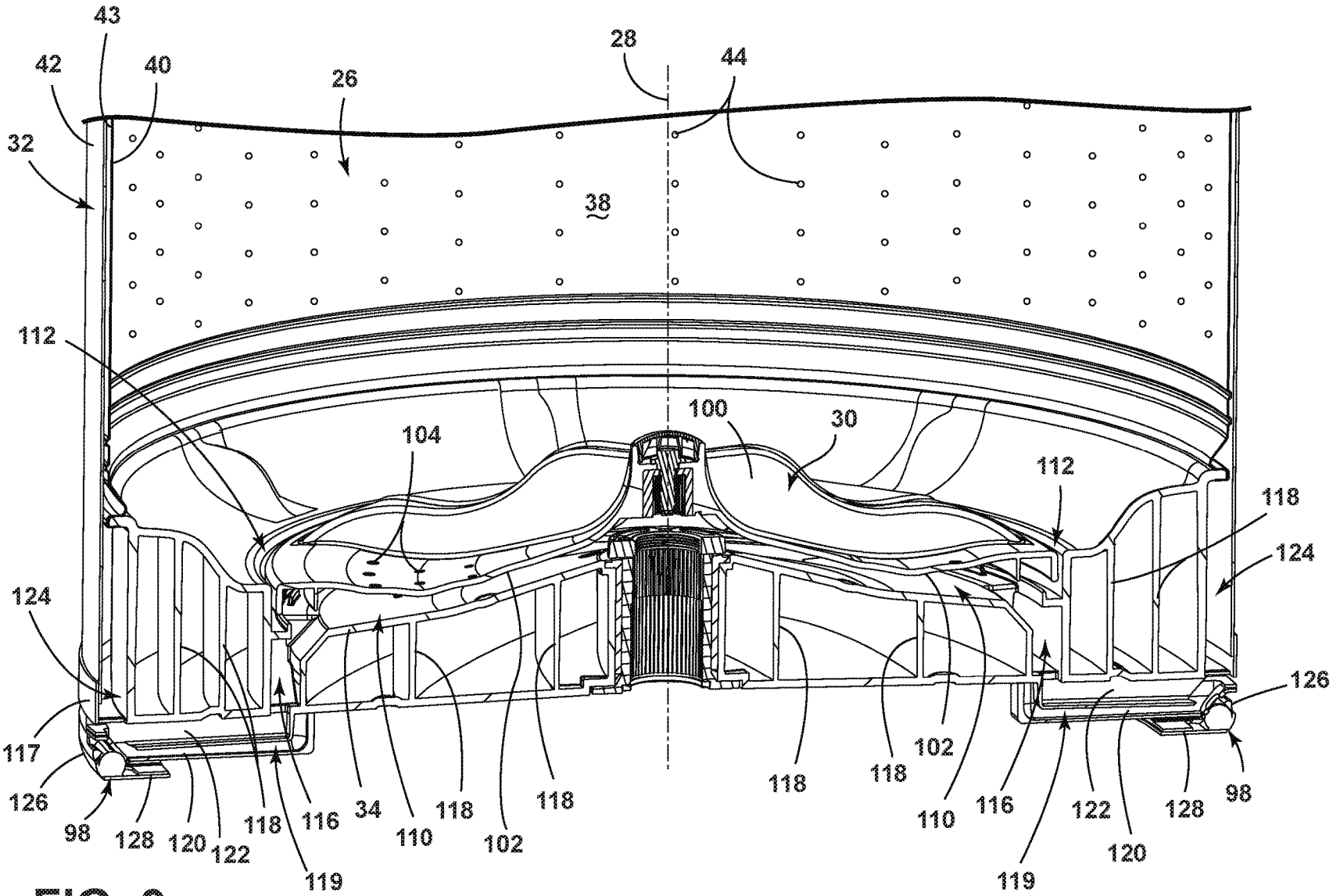
FIG. 3 illustrates a close up sectional view of the basket and float valve assembly of FIG. 1.

Turning to FIG. 3, the laundry mover 30 can comprise an impeller 100 and a plate 102, the plate 102 comprising a plurality of plate holes 104. A gap 110 is defined between the plate 102 and the upper surface of the basket bottom 34, the gap 110 being in fluid communication with the treating chamber through the plate holes 104. Additionally, an annular basket channel 112 is defined between the outer edge of the plate 102 and the basket bottom 34.

The basket bottom 34 further comprises a plurality of base walls 118 providing structural rigidity. A plurality of through holes, shown as basket drains 116, are also disposed within the basket bottom 34, with the basket drains 116 in fluid communication with both the gap 110 and the basket channel 112. A plurality of drain passages 122 are disposed along the lower side of the basket bottom 34 and are in fluid communication with the basket drains 116. The drain passages 122 comprise a channel extending radially outward from, and substantially normal to, the basket axis of rotation 28. The drain passages 122 can be molded as part of the basket bottom 34 or can be welded thereto.

The basket peripheral wall 32 can comprise a dual wall, having an inner wall 40 and an outer wall 42, defining a space 43 therebetween. The inner wall 40 can further comprise a plurality of liquid extraction perforations 44 whereby the treating chamber 38 is in fluid communication with the space 43 through the perforations 44. The outer wall 42 extends downwardly, surrounding the outer surface of the basket bottom 34 and couples to the basket bottom with an annular bottom plate 117 extending around the bottom and lower outer edge of the outer wall. The outer wall further comprises an outer wall drain defining an annular drain channel 124 between the outer wall 42 and the basket bottom 34, the drain channel 124 being in fluid communication with the space 43 as well as the drain passages 122 and the float valve assembly 98. Different drain channels 124 are contemplated, depending on the shapes of the basket bottom 34 and the outer wall 42, the drain channel 124 can be a plurality of shapes, being variable, unique, or rounded in non-limiting examples. Furthermore, the drain channel 124 can be partially filled or blocked by the outer wall 42 or basket bottom 34. In one example, the blockages can direct liquid toward a particular section of the drain channel 124, facilitating drainage through a drain path, which can be defined by the blockages.

A plurality of discrete valve housings 120, defining a valve chamber 119, can mount to the lower surface of the basket bottom 34, corresponding to and surrounding each drain passage 122. Each valve chamber 119 can comprise an elongated shape, comprising a semi-circular cross section, adapted to accommodate each drain passage 122. It is contemplated that the valve housing 120 can be any shape, unique or otherwise, defining any cross section, being sufficient to surround the drain passages 122. Each valve housing 120 couples to a float valve assembly 98, comprising a float body 126 and a rest plate 128.

Figure 4:
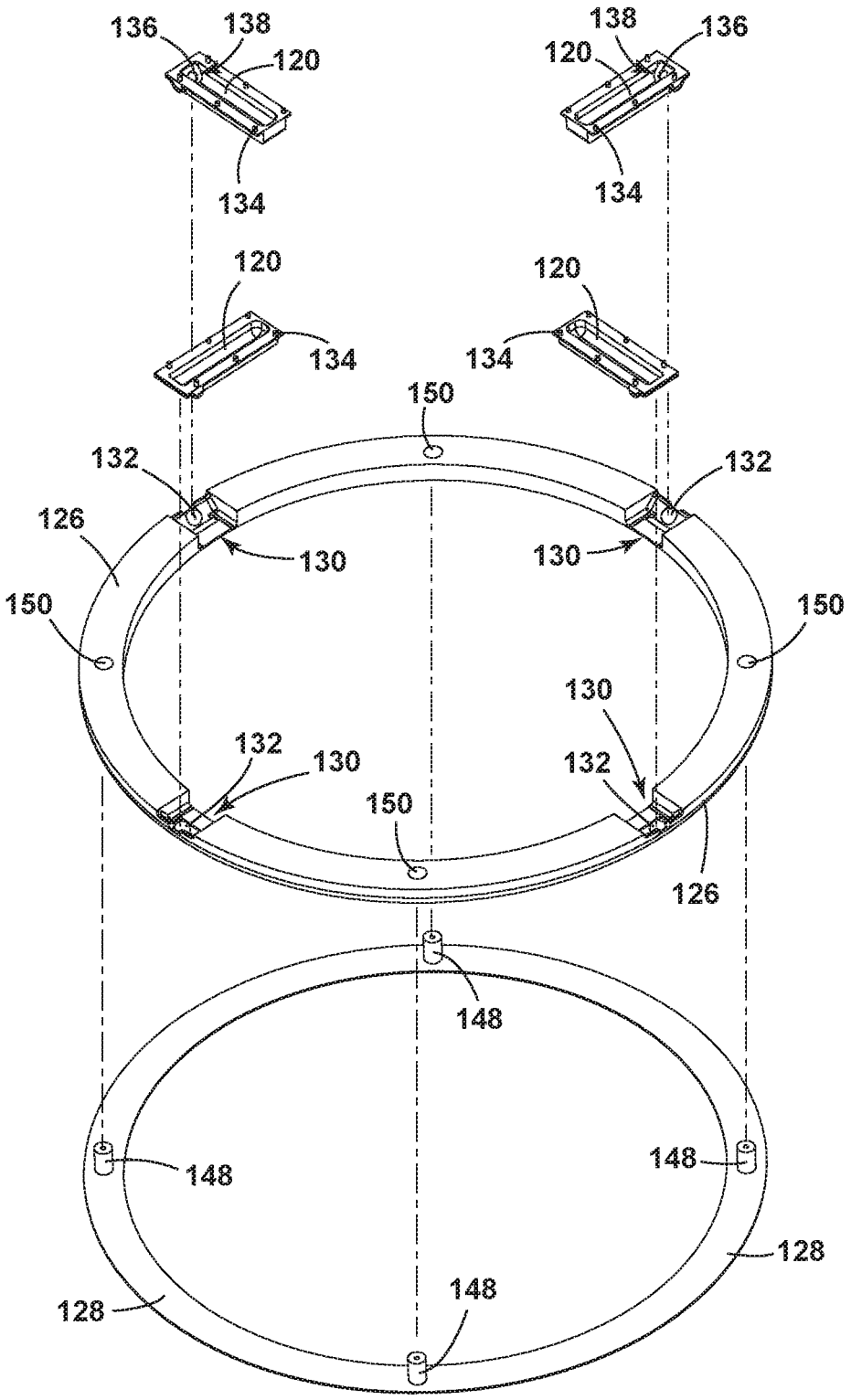
FIG. 4 illustrates an exploded view of the of the float valve assembly of FIG. 3.

Turning now to FIG. 4, the details of the float valve assembly 98 are best seen. The rest plate 128 is a ring comprising a plurality of guideposts 148 extending therefrom. The float body 126 can also be a ring, comprising slots 150 corresponding to and adapted to receive the slidable movement of the guideposts 148 such that the float body 126 can slide down the guideposts 148 and rest on the rest plate 128. While four guideposts 148 are shown corresponding to four slots 150, any number of guideposts 148 and corresponding slots 150 are contemplated. Furthermore, the rest plate 128 and the float body 126 may comprise any shape, circular, quadrilateral, triangular, or otherwise. Further still, both the rest plate 128 and the float body 126 can be separated into multiple or individual sections, disconnected or discrete from one another such that each section of the rest plate 128 includes one or more guideposts 148, and each section of the float body 126 corresponds to one or more rest plates 128, having slots 150 complementary to the guideposts 148.

The float body 126 also comprises one or more recesses 130 and can further comprise a valve body 132 shown as a bulbous protrusion. One or more valve housings 120, shaped for acceptance within the recesses 130 of the float body 126, are provided. The float body 126 can be shaped or adapted to receive any type or number of valve housings 120. The float body 126 can be further divided into multiple discrete sections, each corresponding to one or more individual valve housings 120.

Each valve housing 120 can have a plurality of fasteners 134 for mounting to the basket bottom 34. The valve housings 120 may also weld, seal, or attach to the basket bottom 34 by any method known in the industry. Each valve housing 120 further comprises a membrane defining a valve seat 136, defining a flow opening shown as a valve opening 138 therethrough. The valve seat 136 can be shaped such that the valve opening 138 is defined by an opening through the valve seat 136. The circular opening is shaped to abut and receive an outer surface of the valve body 132, such that reception of the valve body 132 can seal the valve opening 138.

In one variation on the exemplary embodiment shown, the float valve assembly 98 can be separated into multiple individual sections, each section comprising a rest plate 128, a float body 126, one or more guideposts 148 with complementary slots 150, and a valve housing 120. As such, multiple float valve assemblies 98, corresponding to multiple drain openings, can be utilized without interconnection.

Furthermore, the valve body 132 can comprise a plurality of shapes, such as spherical, ellipsoid, cubic, tetrahedral, unique, or otherwise, or any variation therefor, having a complimentarily shaped valve opening 138 within the valve seat 136 such that a functional seal between the valve body 132 and valve opening 138 can be achieved.

Figure 5A:
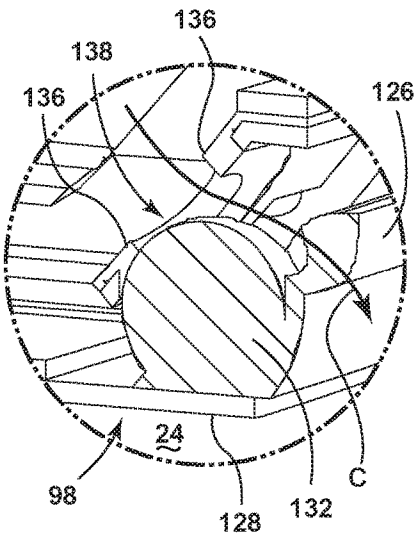
FIG. 5A illustrates a close-up view of the float valve assembly of FIG. 5.
Figure 5:
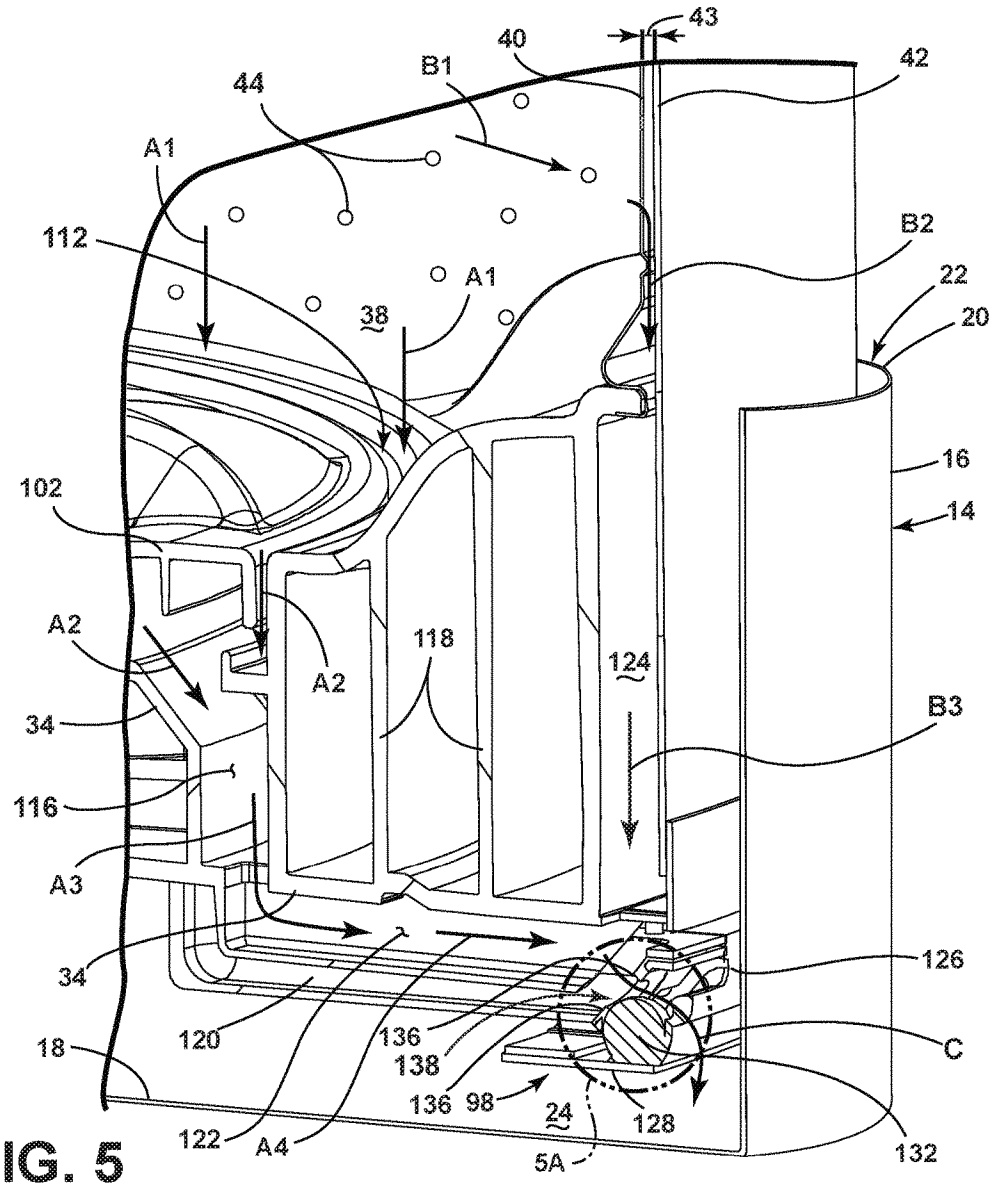
FIG. 5 illustrates the float valve assembly in an opened position to define a first flow path for liquid from the treating chamber to the tub.

In FIG. 5, the float valve assembly 98 is shown in the opened position illustrating two drain paths, A and B, in which liquid may drain from the treating chamber to the float valve assembly 98. In the opened position of the float valve assembly 98, the float body 126 rests against the rest plate 128, having the valve body 132 removed from the valve seat 136, opening the valve opening 138.

A first drain path A comprises flow paths A1, A2, A3, and A4. At A1, liquid can flow from the treating chamber 38, down to the bottom of the treating chamber 38 to the basket bottom 34. At A2, liquid can flow through basket channel 112 or from between the plate 102 and the upper surface of the basket bottom 34 into the basket drain 116. At A3, liquid can flow from the basket drain 116 into the drain passage 122, where, at A4, the liquid can flow to the float valve assembly 98 and into the valve housing 120 surrounding the bottom of the drain passage.

In a second drain path B, comprising flow paths B1, B2, and B3, liquid can flow from the treating chamber 38 to the float valve assembly 98, through the dual walls 40, 42. At B1, liquid within the treating chamber 38 can flow through the perforations 44 and into the space 43 between the dual walls 40, 42. When the valve assembly is in the opened position, during a spin cycle for example, centrifugal force can be used to draw liquid from the treating chamber 38 into the space 43 between the walls 40, 42. At B2, liquid within the space 43 can fall or drain into the drain channel 124. At B3, liquid within the drain channel 124 can flow to the float valve assembly 98 or into the valve housing 120, or both.

At a third drain path C, liquid flowing to the float valve assembly 98 or disposed within the valve housing 120 can flow through the opened valve opening 138 in the valve seat 136 and into the tub interior 24.

FIG. 5A shows a close up view of the float valve assembly 98 of FIG. 5, best showing the elements of the float valve assembly 98 while in the opened position. The float body 126 comprising the valve body 132 rest against the rest plate 128, such that the valve body 132 is not in contact with the valve seat 136. In the opened position, the separated valve body 132 and valve seat 136 permit liquid flow through the valve opening 138, defining the third drain path C, such that the drained liquid flows into the tub interior 24.

In operation, with the float valve assembly 98 in the opened position, the washing machine 10 can be filled with liquid disposed within the treating chamber 38 and any volume in fluid communication with the treating chamber 38. The float valve assembly 98 can be opened, allowing liquid to drain from the washing machine 10 through drain paths A, B, and C. The liquid can flow into the tub 14 from drain paths A, B, and C, and can drain therefrom through a drain conduit 70 to the pump assembly 66.

Figure 6A:
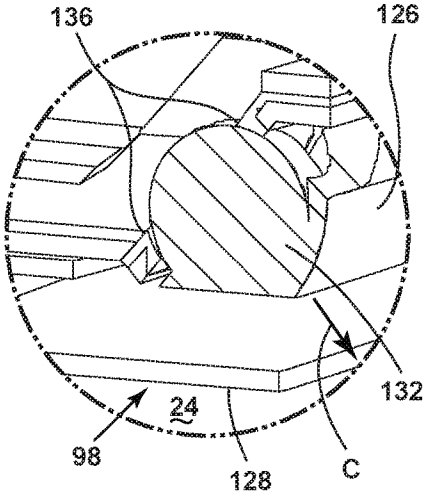
FIG. 6A illustrates a close-up view of the float valve assembly of FIG. 6.
Figure 6:
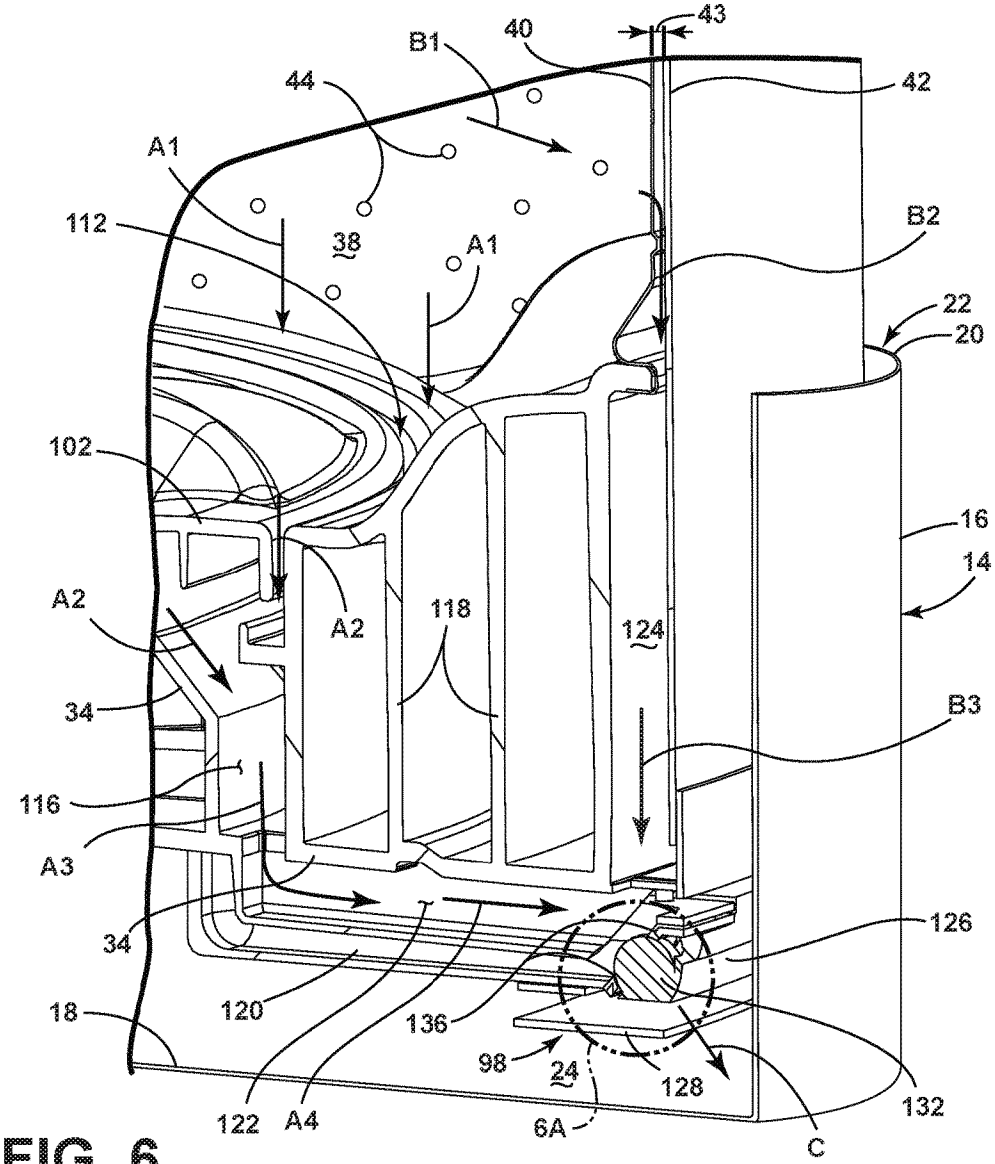
FIG. 6 illustrates the float valve assembly in a closed position to define a second flow path for liquid collecting within the treating chamber.

Turning now to FIG. 6, the float valve assembly 98 is shown in the closed position. In the closed position, the float body 126 is raised off of the rest plate 128 inserting the valve body 132 into the valve seat 136 such that the valve housing 120 is sealed from fluid communication with the tub interior 24.

At drain paths A and B, liquid will flow in the same manner as described regarding FIG. 5. In FIG. 6, liquid moving through either drain path A or B, can flow into the valve housing 120, where it will begin to collect, filling first the valve housing 120 and any other body in fluid communication with the valve housing 120 until the treating chamber 38 begins to fill with liquid. The third drain path C is cut off from the valve housing 120 by the float valve assembly 98 and is not in fluid communication with the treating chamber 38 or any path A, B fluidly coupling thereto.

Turning to FIG. 6A, a close up view of the float valve assembly 98 of FIG. 6, best shows the elements of the float valve assembly 98 while in the closed position. In the closed position, the float body 126 is raised off the rest plate 128, for example, by a rising liquid level in the tub interior 24. As the float body 126 rises, the valve body 132 abuts the valve seat 136, closing the valve opening 138 such that the third drain path C is no longer in fluid communication with the valve housing 120 or any drain path or flow path fluidly coupling the treating chamber 38 to the tub interior 24 through the float valve assembly 98.

In operation, with the float valve assembly in the closed position, the pump assembly 66 being fluidly coupled to the tub 14 can be sealed such that liquid flowing through the washing machine 10, treating chamber 38, and any volume in fluid communication with the treating chamber 38 can flow into the tub interior 24 and fill the tub 14. As the tub 14 fills, the float body 126 can rise with the liquid level. As the liquid level increases, the float body 126 rises to a level where the valve body 132 can seal the valve seat 136, preventing additional liquid draining into the tub 14. The liquid can then fill the valve housing 120 and any volume in fluid communication with the valve housing 120, eventually filling the treating chamber 38.

As can be appreciated, the flow paths seen in FIG. 5 can be used to pour liquid into the tub interior 24, having a closed pump assembly 66, and can fill the tub 14. As the tub fills, the float body 126 will rise with the liquid, moving the valve body 132 into the valve seat 136 closing the float valve assembly 98 and transitioning the opened float valve assembly 98 of FIG. 5 into the closed float valve assembly 98 of FIG. 6. Opening the pump assembly 66 will allow liquid within the tub 14 to drain and the float body 126 to fall, returning the float valve assembly 98 from a closed position seen in FIG. 6 back to an opened position seen in FIG. 5.

Figure 7:
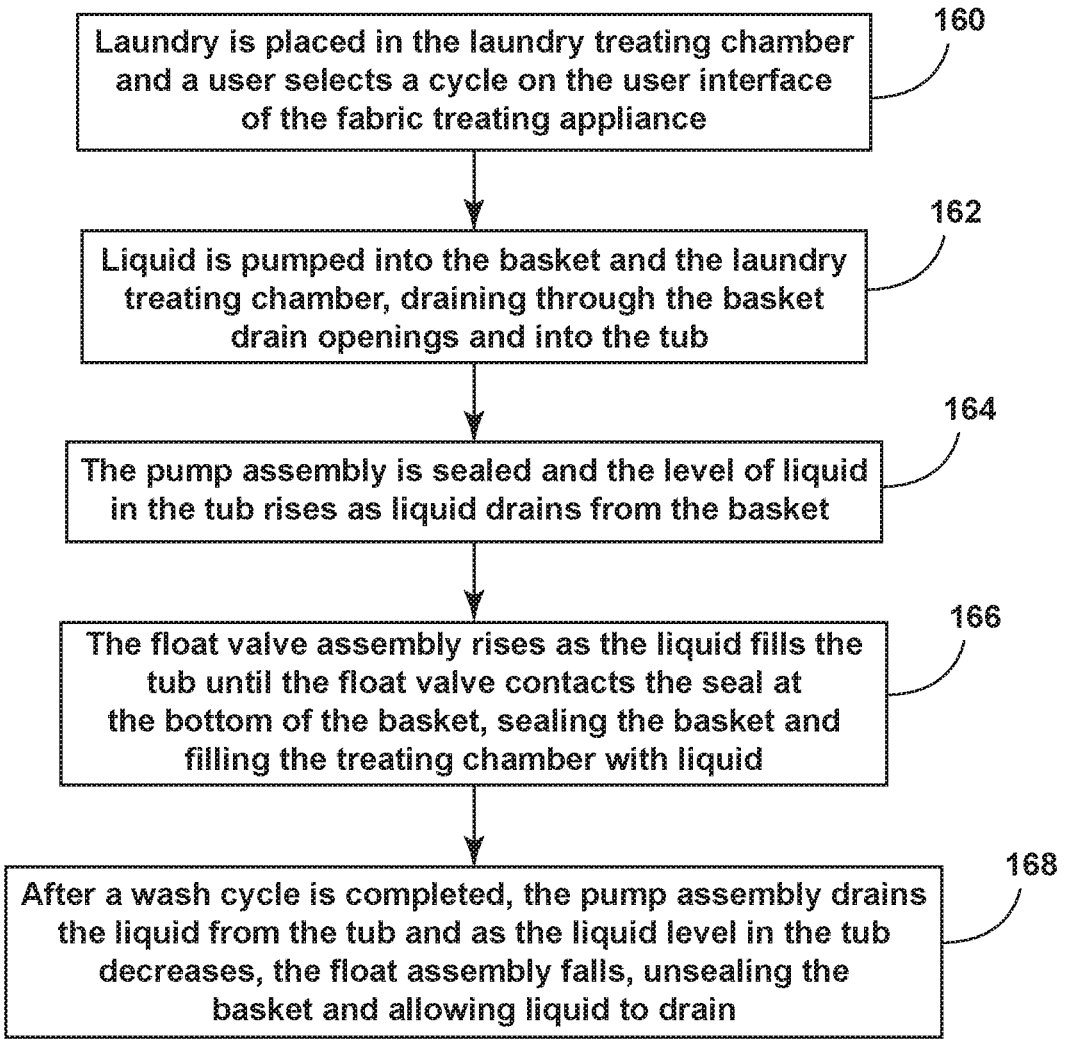
FIG. 7 illustrates a flow chart detailing the method of operation of the fabric treating appliance.

In FIG. 7, the method of operating the washing machine 10 includes, at 160, the user placing fabric or laundry in the laundry treating chamber 38 for treatment. The user can select a treatment cycle on the user interface 84 of the washing machine 10. At 162, liquid is pumped into the basket 26 and the laundry treating chamber 38. The liquid can be pumped from a liquid supply conduit 60 which pours into the treating chamber 38 from a liquid supply outlet 64. Liquid can also pour directly into the tub 14 where the pump assembly 66 can recirculate the liquid through a recirculation conduit 68 to the treating chamber 38 through the liquid supply outlet 64. As the liquid flows into the treating chamber 38, it will drain through the bottom 34 of the basket 26, through the basket channel 112, the basket drain 116, the drain passage 122, the valve opening 138, or through the perforations 44 in the inner wall 40, into the space 43, through the drain channel 124, and into the tub interior 24. At 164, the sealed pump assembly 66 prevents liquid from escaping from the tub interior 24, such that the liquid level rises as liquid collects in the tub 14.

As the liquid level rises, at 166, the float body 126 of the float valve assembly 98 will begin to rise. The float body 126 will float on the liquid as it collects in the tub 14, rising on top of the liquid. The float body 126 will continue to rise until the valve body 132 contacts the valve seat 136, closing the float valve assembly 98. Thus, the treating chamber 38 can fill with liquid sufficient for the cycle selected by the user. As is appreciated, the liquid level can be programmed into the controller 80 such that a predetermined amount of liquid will be necessary to fill the tub 14 and move the float valve assembly 98 into a closed position. Additionally, one or more sensors disposed within the system can be utilized to determine a liquid level such that the washing machine 10 is sufficiently filled.

At 168, after a wash or rinse cycle has completed, the pump assembly 66 can open, permitting the liquid held in the tub interior 24 to drain. As the liquid drains from the tub 14, the float body 126 will descend with the liquid level, separating the valve body 132 from the valve seat 136 and opening the valve opening 138, permitting liquid to drain from the treating chamber 38, into the tub 14, and out through the pump assembly 66.

Additionally, at 168, during a spin cycle, liquid drawn into the gap between the inner and outer walls 40, 42 of the basket 26 can fall through the drain channel 124 and flow into the tub 14 through the opened valve opening 138.

As may be appreciated, the float valve assembly 98 enables the incorporation of a smaller and shorter tub 14. The smaller tub 14 permits increased capacity of the treating chamber 38, as well as saves as much as five gallons of water, or more, per cycle, only needing to fill the tub 14 to a sufficient level to raise the float valve assembly 98 into a closed position.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fabric treating appliance for treating laundry according to a cycle of operation, comprising:

a tub defining a tub interior and having a tub upper terminal edge defining a tub access opening;

a basket defining a laundry treating chamber and having a basket end, an inner wall terminating at a basket terminal edge and having a plurality of perforations, and an outer wall spaced outwardly from the inner wall to define an annular intervening space between the inner wall and the outer wall, the basket end located within the tub interior, the basket terminal edge and at least some of the plurality of perforations located vertically above the tub terminal edge, and the basket having at least one through opening fluidly coupling the laundry treating chamber to the tub interior to define a drain opening; and a float valve having a valve body located within the tub interior and moveable between an opened position, where the valve body is spaced from the drain opening enabling fluid flow through the drain opening, and a closed position, where the valve body closes the drain opening to prohibit fluid flow through the drain opening, in response to a level of liquid in the tub interior;

whereby the basket permits the level of liquid in the laundry treating chamber to fill above the tub terminal edge when the float valve is in the closed position.

2. The fabric treating appliance of claim 1, further comprising multiple drain openings and multiple float valves corresponding to the multiple drain openings.

3. The fabric treating appliance of claim 2 wherein the multiple float valves are physically interconnected.

4. The fabric treating appliance of claim 3 wherein the multiple drain openings are circumferentially spaced about the basket end.

5. The fabric treating appliance of claim 4, further comprising a ring physically interconnecting the multiple float valves.

6. The fabric treating appliance of claim 1 wherein the at least one through opening comprises a passage extending through the basket end.

7. The fabric treating appliance of claim 1 wherein the outer wall further includes an outer wall drain emptying into the tub.

8. The fabric treating appliance of claim 7 wherein the outer wall drain comprises at least one opening in the outer wall and located within the tub interior.

9. The fabric treating appliance of claim 7 wherein the outer wall drain comprises a gap between the inner wall and the outer wall.

10. The fabric treating appliance of claim 1, further comprising a membrane forming a flow opening at the drain opening and the valve body abuts the membrane in the closed position.

11. The fabric treating appliance of claim 10 wherein the valve body comprises a bulbous protrusion moveably mounted to the basket end.

12. The fabric treating appliance of claim 1, further comprising a motor operably coupled to the basket and rotating the basket relative to the tub about a basket axis of rotation.

13. The fabric treating appliance of claim 12, further comprising a drive shaft assembly operably coupling the motor to the basket and the ring circumscribes the drive shaft assembly.

* * * * *